United States Patent [19]

LaBate

[11] Patent Number: 4,538,670

[45] Date of Patent: Sep. 3, 1985

[54] METHOD AND APPARATUS FOR POURING MOLTEN METAL IN A NEUTRAL ATMOSPHERE

[76] Inventor: Micheal D. LaBate, 115 Hazen Ave., Ellwood City, Pa. 16117

[21] Appl. No.: 562,831

[22] Filed: Feb. 6, 1984

[51] Int. Cl.[3] ..... B22D 11/10

[52] U.S. Cl. ..... 164/475; 164/415; 164/437; 222/603

[58] Field of Search ..... 164/437–439, 164/415, 475; 222/603, 591, 606, 607

[56] References Cited

U.S. PATENT DOCUMENTS

| | | | |
|---|---|---|---|
| 3,459,346 | 8/1969 | Tinnes | 222/606 X |
| 3,460,725 | 8/1969 | Heinze-Golde | 222/607 |
| 3,931,850 | 1/1976 | Landgraf | 164/437 |

*Primary Examiner*—Nicholas P. Godici
*Assistant Examiner*—Kenneth F. Berg
*Attorney, Agent, or Firm*—Harpman & Harpman

[57] ABSTRACT

A method and apparatus for pouring molten metal in a neutral atmosphere into an ingot mold, a trumpet funnel for bottom poured ingots or a tundish box for a continuous caster or like vessel is disclosed wherein the receiving vessel is closed about a ceramic sleeve through which the molten metal is poured and wherein the normal atmosphere is replaced by vaporized hexamethylene or cyclohexane as it is sometimes called. The closure about the ceramic sleeve through which the molten metal is introduced into the receiving vessel is positioned on top of the receiving vessel and supports the ceramic sleeve and is provided with break lines or scores that permit the edge portions of the sheet-like closure to be moved in hinged relation thereto when the sheet-like closure is pushed downwardly into the receiving vessel to a point on or near the surface of the molten metal.

15 Claims, 5 Drawing Figures

METHOD AND APPARATUS FOR POURING MOLTEN METAL IN A NEUTRAL ATMOSPHERE

BACKGROUND OF THE INVENTION

1. Technical Field

This invention relates to a method and apparatus for pouring molten metal ino a receiving vessel while excluding atmospheric air therefrom.

2. Description of the Prior Art

No prior art methods or devices are known whereby a relatively simple and inexpensive closure and a pouring sleeve positioned therethrough enable a receiving vessel to be charged with an inert gas and structurally prevent the entrance of atmospheric air thereinto.

SUMMARY OF THE INVENTION

A method and apparatus for pouring molten metal in a neutral atmosphere are disclosed wherein simple and relatively inexpensive apparatus placed on a receiving vessel forms a closed passageway from a ladle, converter or similar source of molten metal to the receiving vessel and is moved to a position on the molten metal in the receiving vessel when the same is filled to maintain the closure with respect to the atmosphere while the molten metal is discharged from the receiving vessel.

A powdered hot top compound may be and preferably is applied to the surface of the molten metal to insure sealing of the same with respect to the atmosphere and the movable closure and closed passageway.

DESCRIPTION OF THE PREFERRED EMBODIMENT

Figure 1:
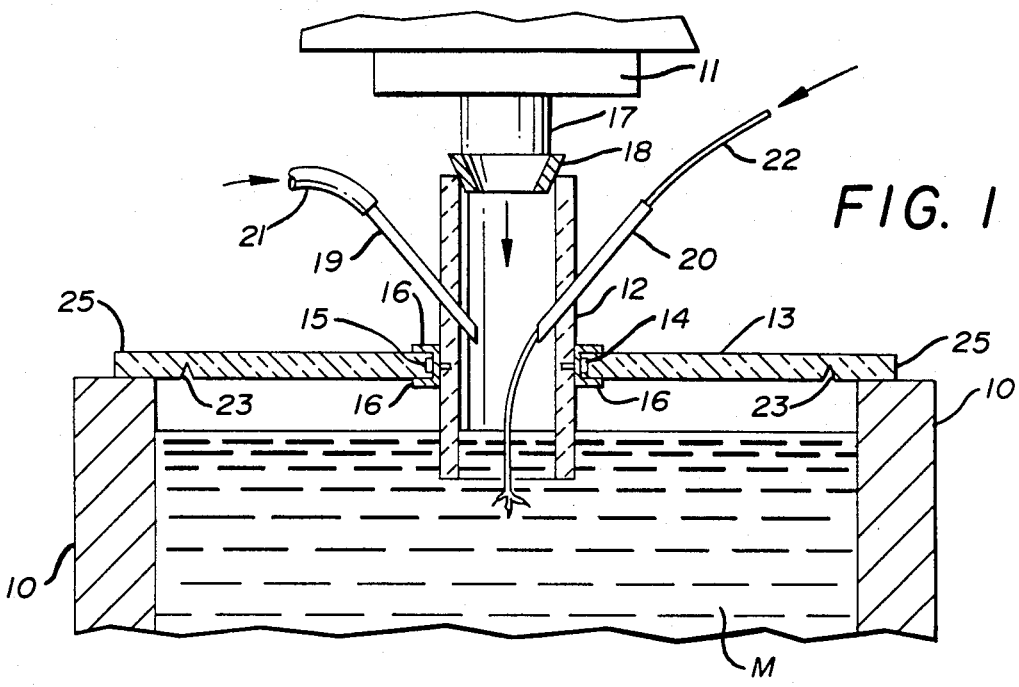
FIG. 1 is a fragmentary vertical section through a portion of an ingot mold and illustrating the atmosphere excluding apparatus in a first position.
Figure 2:
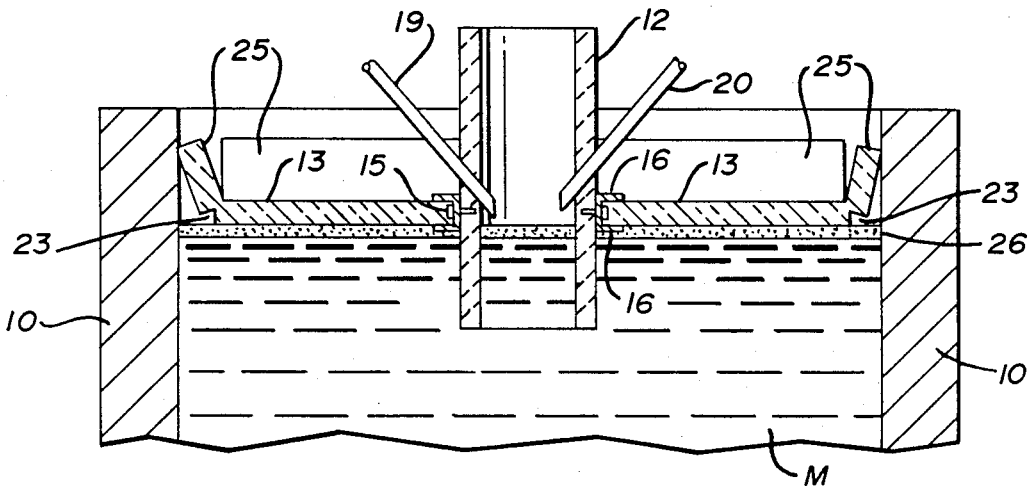
FIG. 2 is a vertical sectional view similar to FIG. 1 showing the atmospheric excluding apparatus in a second position in an ingot mold.
Figure 5:
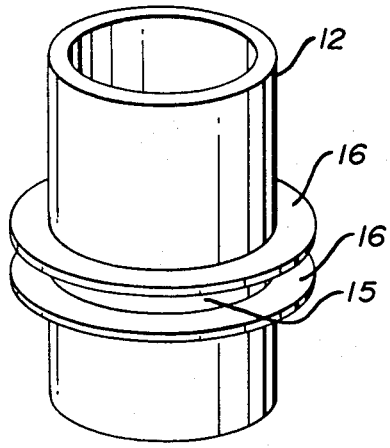
FIG. 5 is a perspective view on an enlarged scale showing a ceramic sleeve which is also seen in FIGS. 1 and 2 of the drawings.
Figure 4:
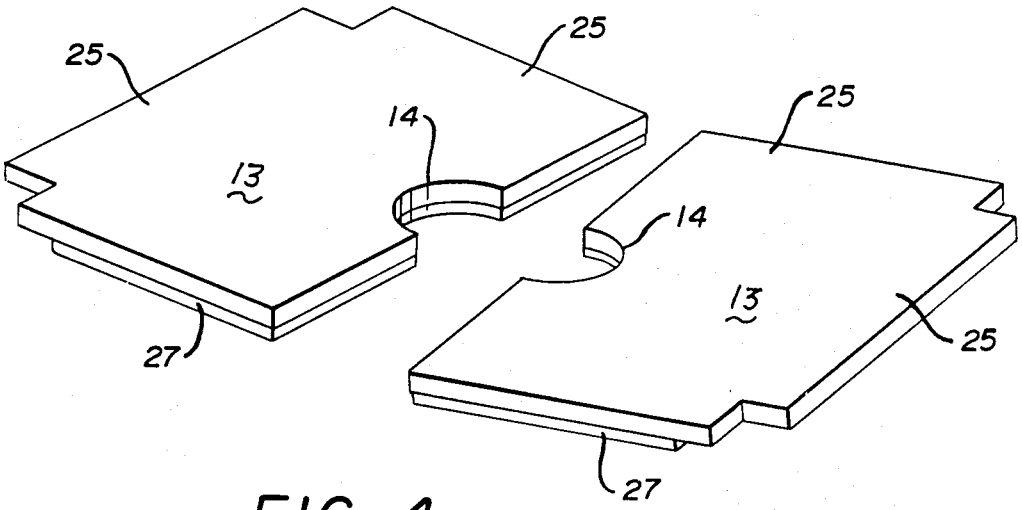
FIG. 4 is an exploded perspective view showing the two portions of a part of the apparatus of FIGS. 1 and 3.

By referring to the drawings and FIG. 1 in particular, a fragmentary view of the upper portion of a receiving vessel 10 which may be an ingot mold or a trumpet funnel for bottom poured ingots or a tundish box for a continuous caster will be seen to be substantially filed with molten metal M which has been introduced into the receiving vessel 10 from a ladle 11 or other source of molten metal. The molten metal M is introduced into the receiving vessel 10 through a ceramic sleeve 12 which is positioned substantially centrally of the open upper end of the receiving vessel 10 and supported by sheet-like sections 13 of insulating fiber board. The sheet-like section 13 of insulating fiber board are formed with oppositely disposed half-circular cut outs 14 as may be seen by referring to FIG. 4 of the drawings and an annular metal band 15 having vertically spaced horizontally extending annular flanges 16 are attached to the ceramic sleeve 12 by suitable fasteners and receives the oppositely disposed sections 13 of the insulating fiber board, the cut out portions 14 thereof registering in the space between the annular flanges 16 and in abutting relation to the annular metal band 15. Molten metal is introduced into the upper end of the ceramic sleeve 12 from the ladle or other source of molten metal by way of a tapered nozzle 17, the lower end portion of which is provided with an air lock gasket 18 formed of suitable refractory fiber materials and the like which is of an overall tapered shape and thereby capable of registering in the open upper end of the ceramic sleeve 12 and forming an airtight closure.

A pair of pipes 19 and 20 are positioned through the annular wall of the ceramic sleeve 12, the pipe 19 being connected by a flexible hose 21 with a source of inert gas, such as argon, and the pipe 20 provides a suitable lead-in for a lead wire 22 which can be introduced into the molten metal therethrough as desired.

Figure 3:
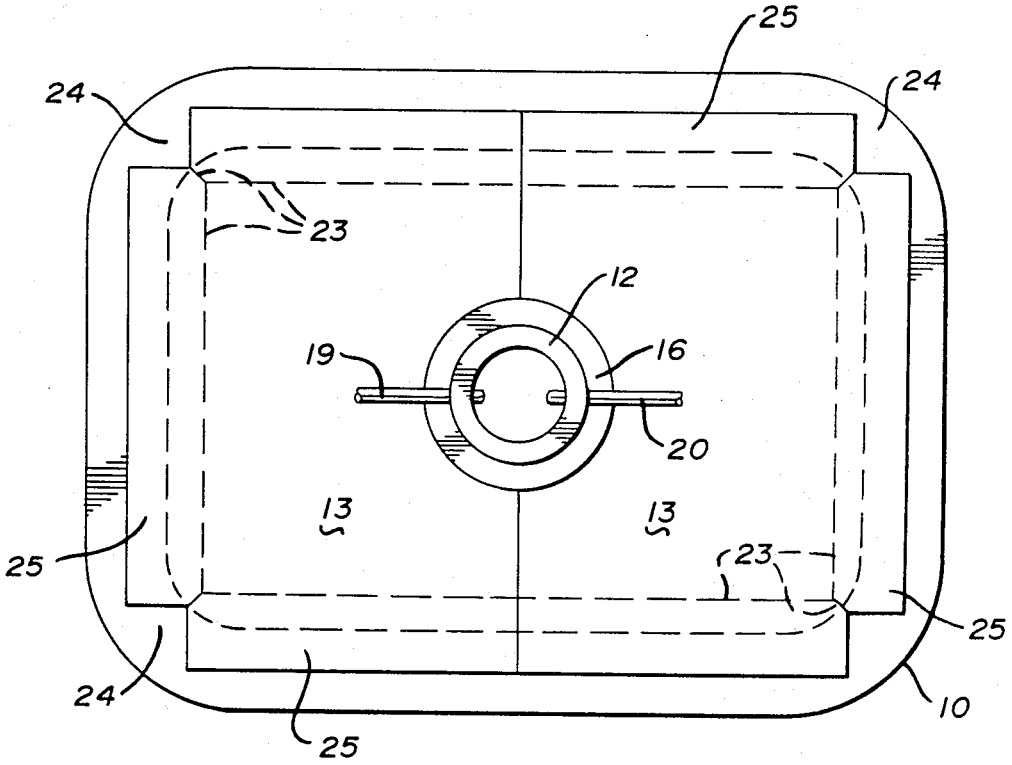
FIG. 3 is a top plan view of the apparatus seen in FIG. 1.

Still referring to FIG. 1 of the drawings, it will be seen that the lower surface of each of the sheet-like sections 13 of insulating fiber board is provided with break or score lines 23 defining a rectangular shape slightly smaller than the inner rectangular shape of the receiving vessel 10 and by referring to FIG. 3 of the drawings, a top plan view of the apparatus enabling the pouring of molten metal in a neutral atmosphere will be seen to include broken line representations of the break lines or score lines 23 together with diagonal extensions thereof at the four corners of the sheet-like sections 13 and connecting with the cut out corners thereof as indicated by the numerals 24.

In FIG. 3 of the drawings, the ceramic sleeve 12 is shown along with the upper one of the annular flanges 16 which extend horizontally from the annular metal band 15 hereinbefore described.

At such time as the receiving vessel 10 is filled to a desired level and the inert gas flow continues, an edge portion 25 of the sheet-like sections 13 and/or the ladle 11 and nozzle 17 is lifted and, a covering coating of powdered hot top compound 26 as known in the art, is applied to the surface of the molten metal. The sheet-like sections 13 of insulating fiber board carrying the ceramic sleeve 12 are then pushed downwardly so as to bend the longitudinal edge portions 25 thereof in angular relation thereto and form four angularly disposed edge sections resembling wipers, each attached to the respective sheet-like sections 13 of the insulating fiber board and each continuously engaging the inner walls of the receiving vessel so as to form an airtight closure.

When the sections 13 of the sheet-like insulating fiber board are pushed downwardly to contact either the molten metal M or the powdered hot top compound floating thereon, a secondary closure, not shown, may be applied to the open upper end of the ceramic sleeve 12 or an additional amount of the powdered hot top compound may be placed therein to effectively seal the surface of the molten metal in the ceramic sleeve 12. At the same time the pipes 19 and 20 may be disconnected from their respective sources of gas or metal and/or removed completely and as the molten metal M in the receiving vessel is fed therefrom as for example into a continuous caster, the entire sealing apparatus descends with the level of the molten metal M and maintains the atmospheric seal.

In order to insure the existence of a desirable neutral atmosphere in the receiving vessel 10 when the first molten metal is poured therein a small quantity of hexamethylene, also known as cyclohexane, or any other similar readily vaporizable liquid having similar properties is introduced into the receiving vessel when the closure apparatus is first installed so that the introduction of the first molten metal into the receiving vessel will immediately vaporize the same and create a suitable gaseous environment that will expel all of the usual atmospheric air from the receiving vessel 10 and thus prevent contamination by the reoxidation of the molten metal and the undesirable products thereof.

Modifications in the apparatus for pouring molten metal in a neutral atmosphere will occur to those skilled in the art and one such modification may comprise the addition of exothermic material as known in the art into the sheet-like sections 13 of insulating fiber board and/or attaching sections of exothermic material 27 to the lower surfaces of the sheet-like sections 13 of insulating fiber board so that the reaction of the exothermic material will add additional heat to the metal in the receiving vessel and avoid the usual piping problems that occur for example when molten metal is solidified in an ingot mold or the like.

It will be understood by those skilled in the art that the ceramic sleeve 12 is formed of refractory materials that readily withstand the temperature of molten metal and that the sheet-like sections 13 are formed of refractory fibers such as aluminum silicate in a mixture which may include dolomite, sodium silicate, pink clay, mineral wool, etc. and a suitable binder material such as a phenol formaldehyde resin.

The apparatus disclosed herein makes possible a method of pouring steel or other metal into a receiving vessel such as an ingot mold, trumpet funnel for bottom poured ingots or tundish boxes for continuous casters without subjecting the molten metal to the usual atmosphere and thereby reduces or eliminates the possibility of products of reoxidation forming in the molten metal as would otherwise occur. The method comprises the introduction into the receiving vessel of a known quantity of hexamethylene capable of forming a gaseous cloud upon subjection to molten metal initially contacting the same and acting to purge the normal atmosphere from the receiving vessel, placing a pair of oppositely disposed sheet-like sections of insulating fiber board on either side of a ceramic sleeve in registering configurations in the fiber board and positioning the fiber board sections as assembled to the ceramic sleeve on the top of the receiving vessel, sealing the edges of the fiber board sections to the upper surfaces of the receiving vessel, bringing an outlet port nozzle of a ladle or the like source of molten metal into engagement with the upper end of the ceramic sleeve, directing molten metal through said ceramic sleeve into said receiving vessel to a desired height therein, adding a topping of powdered hot top compound, such as acid treated graphite or a similar material, to the surface of the molten metal and moving the sheet-like sections of insulating fiber board and the ceramic sleeve carried thereby downwardly onto the surface of the molten metal and the hot top compound thereon and permitting said sections of insulating fiber board and the ceramic sleeve carried thereby to move downwardly in the receiving vessel with the molten metal when the same is withdrawn therefrom so as to maintain a continuous seal and prevent the introduction of atmosphereic air into the receiving vessel and its contact with the molten metal therein.

The horizontally disposed heat resistant closure 13 is preferably formed of low thermal conductivity refractory material such as inorganic fibrous material, particulate material and an organic binder; the inorganic fibrous material being selected from the group consisting of asbestos, calcium silicate fiber, aluminosilicate fiber and alumina fiber; the particulate refractory material being selected from the group consisting of silica, alumina, zircon, olivine, magnesia, aluminosilicates and carbonaceous materials; and the organic binder being selected from the group consisting of synthetic resins, natural resins and carbohydrates.

It will thus be seen that a method and apparatus for pouring molten metal into an ingot mold or a tundish box on a continuous caster has been disclosed which is relatively simple to perform with the use of a relatively inexpensive apparatus and it will be observed that the apparatus is formed of materials including inorganic fibrous material, particulate refractory material and ceramic material which may be easily discarded and replaced when eroded by contact with the molten metal protected thereby.

Having thus described my inventions, what I claim is:

1. The combination of a molten metal receiving vessel having substantially vertically standing walls and means for closing said vessel to the atmosphere and directing molten metal into said closed vessel; said means including a horizontally disposed closure formed of low thermal conductivity refractory material having an opening therein, a heat resistant sleeve in said opening having an upper end above and a lower end below said closure, said upper end positioned for registry with a nozzle of a ladle, a heat resistant deformable air lock gasket engaging said upper end of said sleeve and said nozzle, said closure having score lines to enable said closure to be movable from a first position on the lip portion of said vessel to a second position in said vessel engaging molten metal therein and arranged to float on said molten metal when the level of said molten metal falls below said second position.

2. The combination of claim 1 wherein said horizontally disposed closure is a sheet-like shape larger than and corresponding to the shape of the vessel and overlying the same.

3. The combination of claim 2 wherein the sheet-like shape of the horizontally disposed closure has score lines in its lower surface defining an area smaller than the interior of said vessel and wherein the edge portions of the sheet-like shape beyond the score lines are bendable upward in hinged relation to said sheet-like shape when said closure moves into said second position.

4. The combination of claim 1 wherein said closure is formed in two parts, each having a cutaway area therein, said cutaway areas positioned in registry with each other and forming said opening in which said sleeve is disposed.

5. The combination of claim 1 and wherein a flanged circular band is positioned on said sleeve inwardly of the ends thereof with said flange resting on said closure around said opening therein so as to support said sleeve thereon and close the opening thereabout.

6. The combination of claim 5 wherein said band has spaced upper and lower annular flanges thereon, said upper flange resting on said closure and closing said opening and said lower flange engaging the lower surface of said closure and forming a secondary closure for said opening.

7. The combination of claim 1 and wherein the material of which said closure is formed comprises inorganic fibrous material, particulate refractory material and a binder.

8. The combination of claim 1 and wherein the inorganic fibrous material is selected from the group consisting of asbestos, calcium silicate fiber, aluminosilicate fiber and alumina fiber.

9. The combination of claim 1 and wherein the material of which said sleeve is formed is ceramic.

10. The combination of claim 7 wherein the binder is an organic binder selected from the group consisting of synthetic resins, natural resins and carbohydrates.

11. The combination of claim 1 and wherein said closure also contains an exothermic component.

12. A closure for a tundish of a continuous caster and the like, said closure comprising a heat resistant fiberboard having an opening therein, a heat resistant sleeve positioned in sealing relation in said opening and extending upwardly above said closure and downwardly below said closure and having open upper and lower ends, said closure having score lines to enable said closure to be moved from a first position on said tundish to a second position in said tunish for engaging hot metal therein and arranged to float on said hot metal when the level of said hot metal falls below said second position.

13. The method of pouring molten steel into a tundish on a continuous caster in an oxygen free atmosphere comprising the steps of sequentially; placing a flat closure on said tundish in air sealing relation thereto; placing a sleeve in an opening in said closure in sealing relation thereto with part of said sleeve above said closure and part of said sleeve below said closure; placing a known quantity of hexamethylene in said tundish; engaging the nozzle of a ladle in sealing relation in said sleeve; pouring molten steel through the nozzle of the ladle through said sleeve and into said tundish so as to vaporize said hexamethylene to fill said tundish and expel atmospheric air therefrom; pouring molten steel through said nozzle and sleeve to fill said tundish with said molten steel to a level submerging at least a portion of said sleeve; moving said closure and sleeve into said tundish to rest on said molten steel.

14. The method of claim 13 wherein a portion of said closure is moved away from said tundish sufficiently to permit a hot topping compound to be placed on said molten steel when said molten steel in said tundish reaches said level submerging at least a portion of said sleeve and replacing said portion of said closure on said tundish.

15. The method of pouring molten steel into an ingot mold in an oxygen free atmosphere comprising the steps of sequentially; placing a flat closure on said ingot mold in air sealing relation thereto; placing a sleeve in an opening in said closure in sealing relation thereto with part of said sleeve above said closure and part of said sleeve below said closure; placing a known quantity of hexamethylene in said ingot mold; engaging the nozzle of a ladle in sealing relation in said sleeve; pouring molten steel through the nozzle of the ladle through said sleeve and into said ingot mold so as to vaporize said hexamethylene to fill said ingot mold and expel atmospheric air therefrom; pouring molten steel through said nozzle and sleeve to fill said ingot mold with said molten steel to a level submerging at least a portion of said sleeve; moving said closure and sleeve into said ingot mold to rest on said molten steel.

* * * * *